US012352461B2

(12) United States Patent
Wagner et al.

(10) Patent No.: US 12,352,461 B2
(45) Date of Patent: Jul. 8, 2025

(54) HINGE ASSEMBLY

(71) Applicant: Driploc, Inc., Oklahoma City, OK (US)

(72) Inventors: Barry E. Wagner, Oklahoma City, OK (US); Benjamin P. Glenn, Oklahoma City, OK (US)

(73) Assignee: Driploc, Inc., Oklahoma City, OK (US)

( * ) Notice: Subject to any disclaimer, the term of this patent is extended or adjusted under 35 U.S.C. 154(b) by 414 days.

(21) Appl. No.: 17/971,179

(22) Filed: Oct. 21, 2022

(65) Prior Publication Data

US 2023/0055219 A1 Feb. 23, 2023

Related U.S. Application Data

(63) Continuation-in-part of application No. 17/193,230, filed on Mar. 5, 2021, now Pat. No. 11,788,745.

(51) Int. Cl.

| | |
|---|---|
| ***E05F 1/12*** | (2006.01) |
| ***F24F 7/02*** | (2006.01) |
| ***F24F 13/14*** | (2006.01) |

(52) U.S. Cl.
CPC ..... *F24F 13/1486* (2013.01); *F24F 7/025* (2013.01); *F24F 13/1413* (2013.01)

(58) Field of Classification Search
CPC ..... E05F 1/1238; E05F 3/20; E05F 1/123; E05D 3/04; E05D 3/02
See application file for complete search history.

(56) References Cited

U.S. PATENT DOCUMENTS

| | | | | |
|---|---|---|---|---|
| 2,431,263 | A * | 11/1947 | Lundgren | A47K 13/26 D23/311 |
| 2,510,827 | A * | 6/1950 | Mcdonald | E05D 3/04 160/90 |
| 3,715,777 | A * | 2/1973 | Hallamore | E05D 5/04 16/390 |
| 4,589,164 | A * | 5/1986 | Leonard | F16F 1/16 403/397 |
| 4,658,447 | A * | 4/1987 | Smith | A47K 13/12 16/329 |
| 5,090,166 | A * | 2/1992 | Johnson | E04B 7/022 52/693 |
| 5,874,292 | A * | 2/1999 | McMinn, Jr. | B08B 9/0327 126/299 F |
| 6,039,336 | A * | 3/2000 | Frey | B60G 9/003 280/124.132 |
| 6,716,099 | B2 * | 4/2004 | Pfleiderer | F24F 7/02 454/41 |

* cited by examiner

*Primary Examiner* — Brian E Glessner
*Assistant Examiner* — Daniel J Kenny
(74) *Attorney, Agent, or Firm* — Baker Donelson Bearman Caldwell & Berkowitz, PC

(57) ABSTRACT

A hinge assembly includes a pair of lower mounting brackets, at least two upper hinge leaves, a pair of side brackets coupled to the sidewalls of the ventilation fan lid, each side bracket having at least one third axle hole therethrough, an axle pivotally coupling the upper hinge leaves to the lower mounting brackets. Each lower mounting bracket has a vertically oval-shaped axle hole. Each upper hinge leaf includes a U-shaped mounting member and a hook shaped clamping plate coupled to the U-shaped mounting member through threaded tension bolts. The upper hinge leaf also has a pair of axle holes. The axle extends through the elongated axle holes of the lower mounting bracket vertical flange and through the axle holes of the U-shaped member.

23 Claims, 10 Drawing Sheets

HINGE ASSEMBLY

CROSS REFERENCE TO RELATED APPLICATIONS

This is a continuation-in-part of U.S. patent application Ser. No. 17/193,230 filed May 15, 2021 and entitled "Hinge Assembly", and is incorporated herein by reference.

STATEMENT REGARDING FEDERALLY SPONSORED RESEARCH OR DEVELOPMENT

Not applicable.

The Names of the Parties to a Joint Research Agreement

Not applicable.

FIELD OF THE INVENTION

The invention relates generally to hinge assemblies, and more particularly to a hinge assembly for hinged lids which support the rooftop ventilator.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

In commercial ventilation systems for buildings, exhaust fans are mounted over vents on a roof. For example, a fan-assisted vent at a restaurant permits an exhaust to be withdrawn from the kitchen. Through this vent, grease and other cooking residue are allowed to leave the building. After a period of use, the vent, duct and fan become contaminated with grease. Other cooking residue also becomes adhered to the fan blades and other surfaces. Such residue can be flammable and presents a fire hazard, and can also attract undesirable microbes and illness-causing bacteria, requiring occasional cleaning.

In most of these systems, a rectangular base housing rises above the roof vent, and the open base housing is covered by a rectangular or square lid. The lid is sometimes referred to as a shoebox lid, because it is similar in construction to a cardboard shoebox, but formed from sheet metal. A large hole exists in the lid, and the fan is securely mounted to the lid. The National Fire Protection Association (NFPA) 96 "Standard for Ventilation Control and Fire Protection of Commercial Cooking Operations", federal, county, city, and local codes require fans and duct work to be inspected, cleaned if necessary, and maintained. Additionally, it is required that the hinged upblast fan include service hold open retainer to permit inspection and cleaning for the commercial cooking equipment. For maintenance purposes, the lid is typically hinged to the base housing, allowing a worker to raise the lid and rotate the lid and fan assembly away from the base housing for proper access.

The problem for many workers is that the lid can be difficult to grasp, requiring the worker to lift the edges of the lid with fingers, and then rotate the heavy fan and lid assembly back into a fixed open position. A similar difficulty exists when closing the lid when the work is finished, because the worker must grip the side of the lid and gently allow it to close, being careful not to get his fingers pinched between the lid and the base housing. Furthermore, the lid itself can be somewhat flexible, and it may become deformed or otherwise misshapen over the course of time and extensive use, resulting in an imprecise fit between the lid and the base housing.

Therefore, there is a need for a device which can be attached to the lid that allows for easier and safer opening and closing of the lid when maintenance is required. The device should be simple to install and use, and it should not require any irreversible modifications, such as drilling for fasteners, to the lid itself.

BRIEF SUMMARY OF THE INVENTION

In a preferred form of the invention, a hinge assembly comprises a pair of upper hinge leaves wherein each upper hinge leaf has a U-shaped member with a pair of mounting flanges having first axle holes therethrough. Each upper hinge leaf also has a clamping plate adjustably mounted to the U-shaped member. The hinge assembly also has a pair of lower mounting brackets, wherein each lower mounting bracket has at least one second axle hole therethrough, and a pair of side brackets coupled to the sidewalls of the ventilation fan lid, each side bracket having at least one third axle hole therethrough. The hinge assembly also has an axle extending through the first axle holes of the pair of upper hinge leaves and through the second axle holes of the pair of lower mounting brackets.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF CERTAIN EMBODIMENTS

Figure 1:
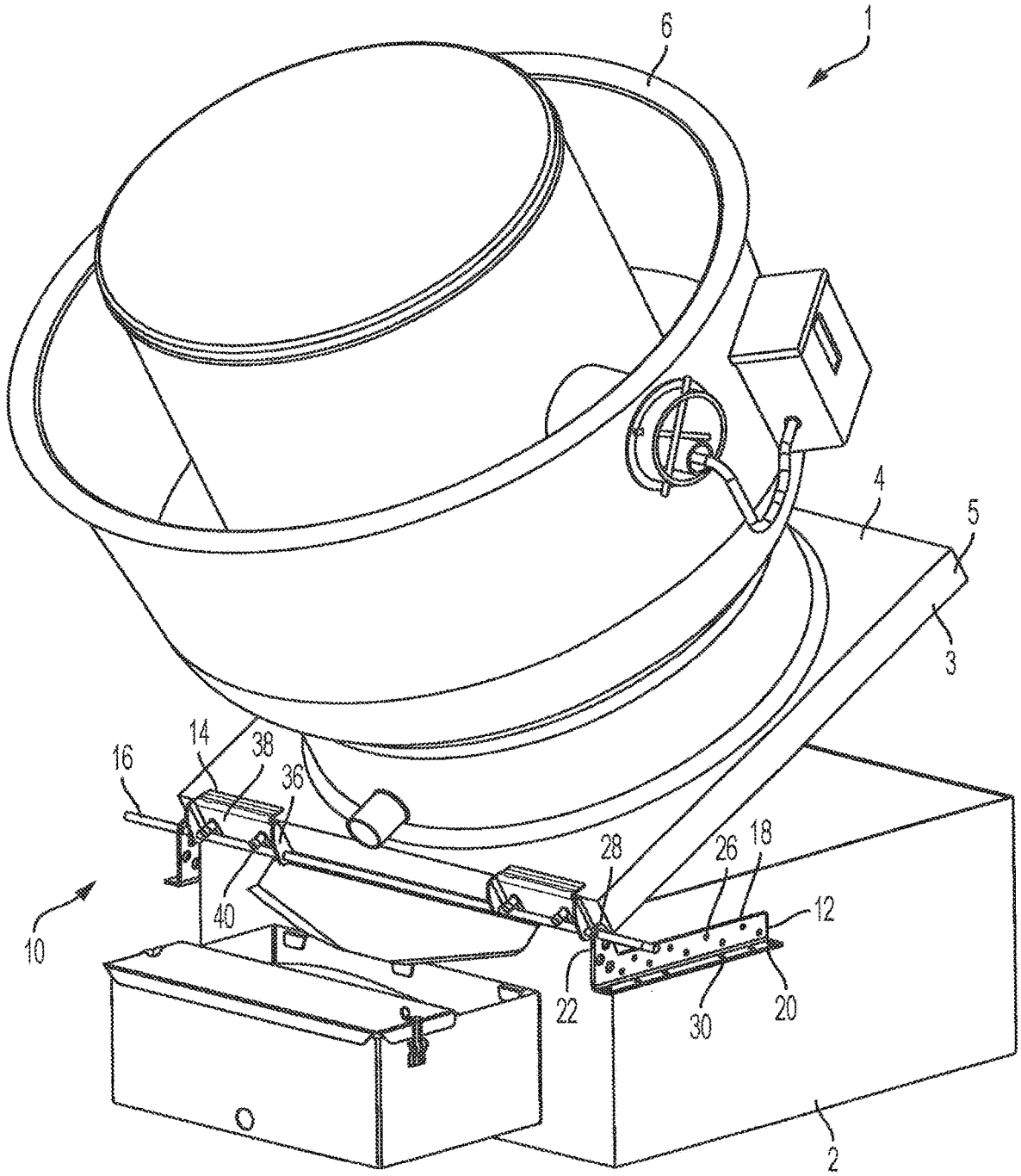
FIG. 1 is a perspective view of the hinge assembly embodying principles of the invention in a preferred form, shown mounted to the side surface of a conventional roof ventilation system having a fan base housing with vertical sidewalls.
Figure 2:
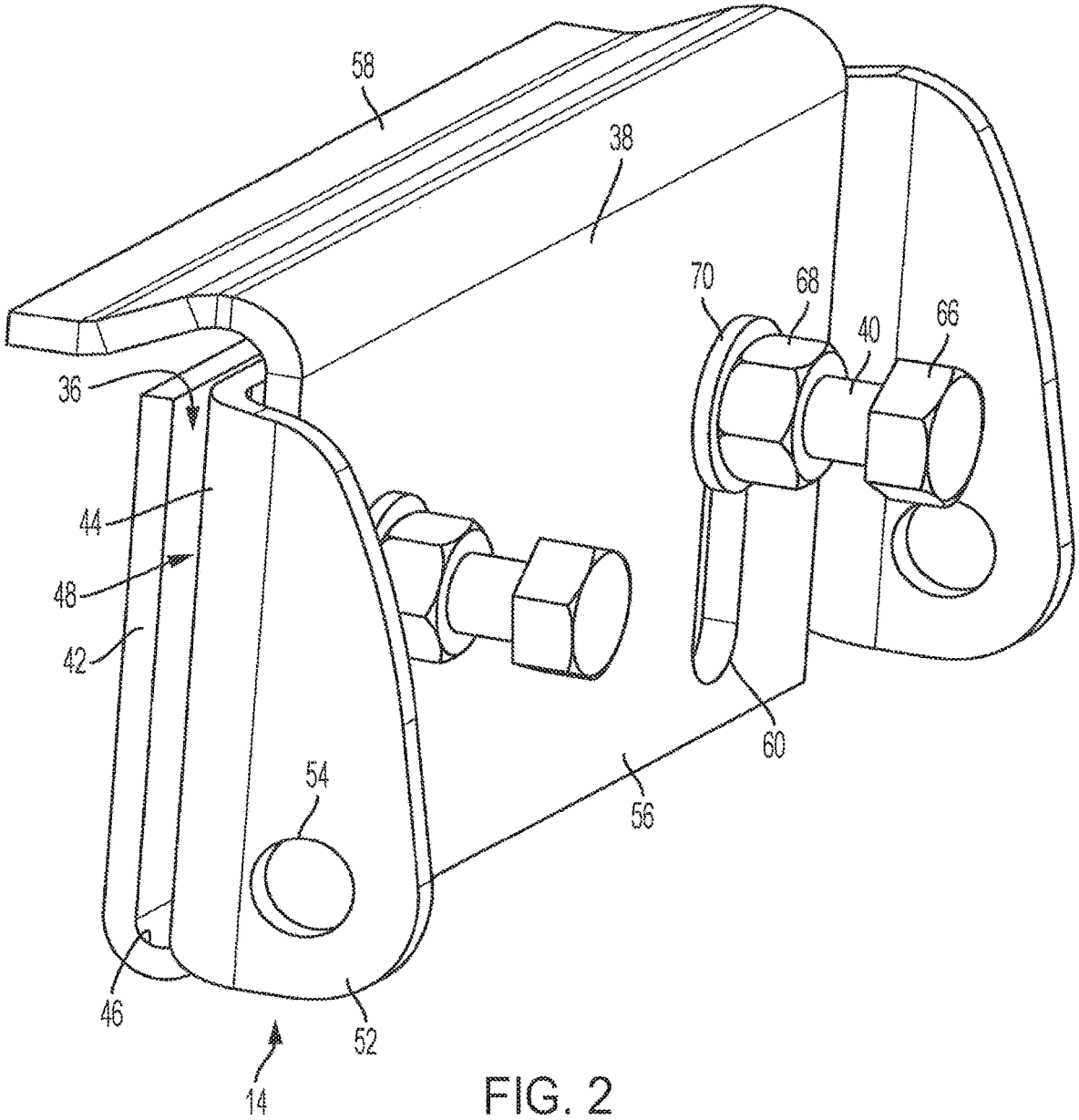
FIG. 2 is a perspective view of an upper hinge leaf of the hinge assembly of FIG. 1.
Figure 3:
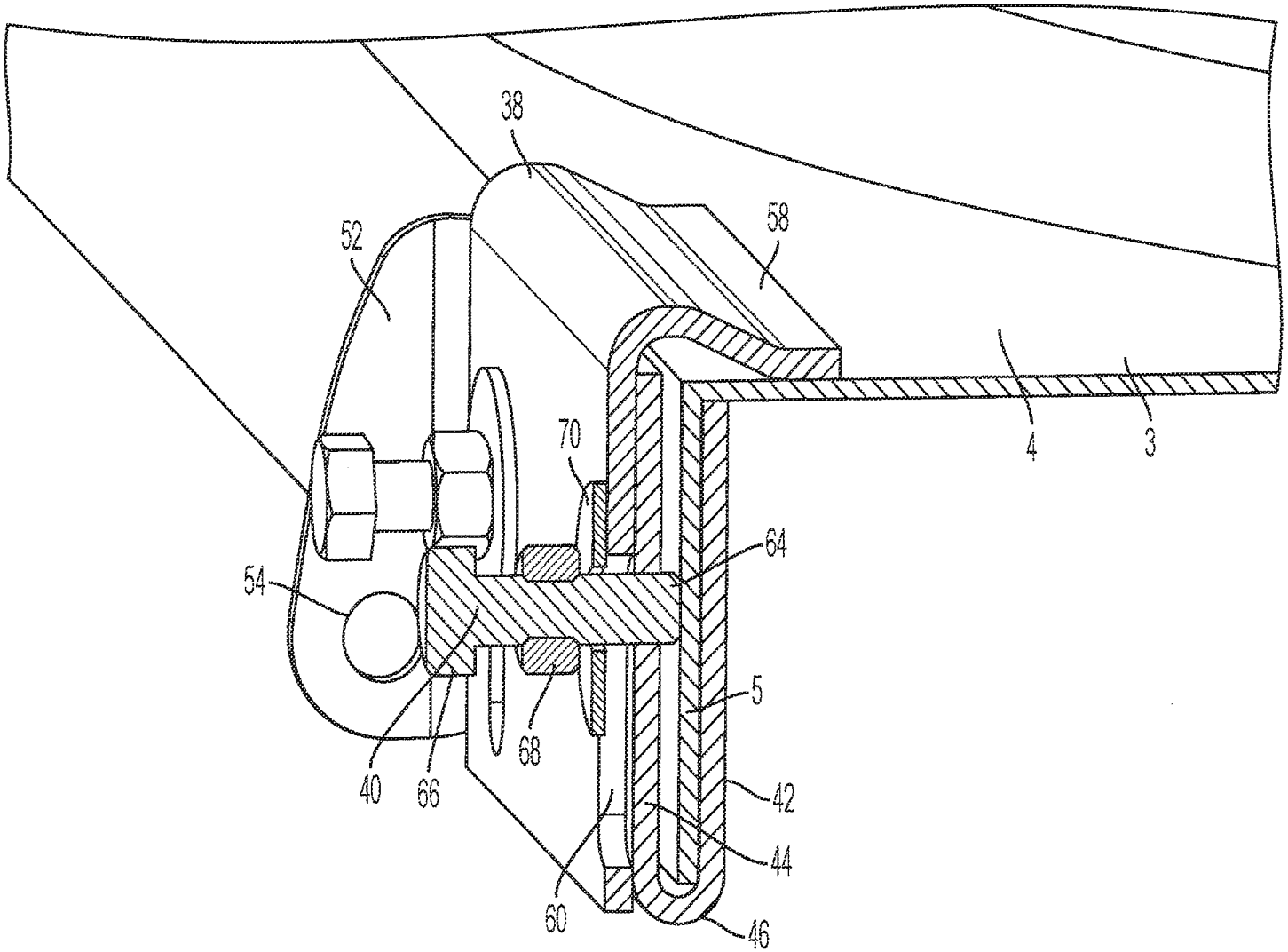
FIG. 3 is a perspective view of a clamping plate of the hinge assembly of FIG. 1.
Figure 4:
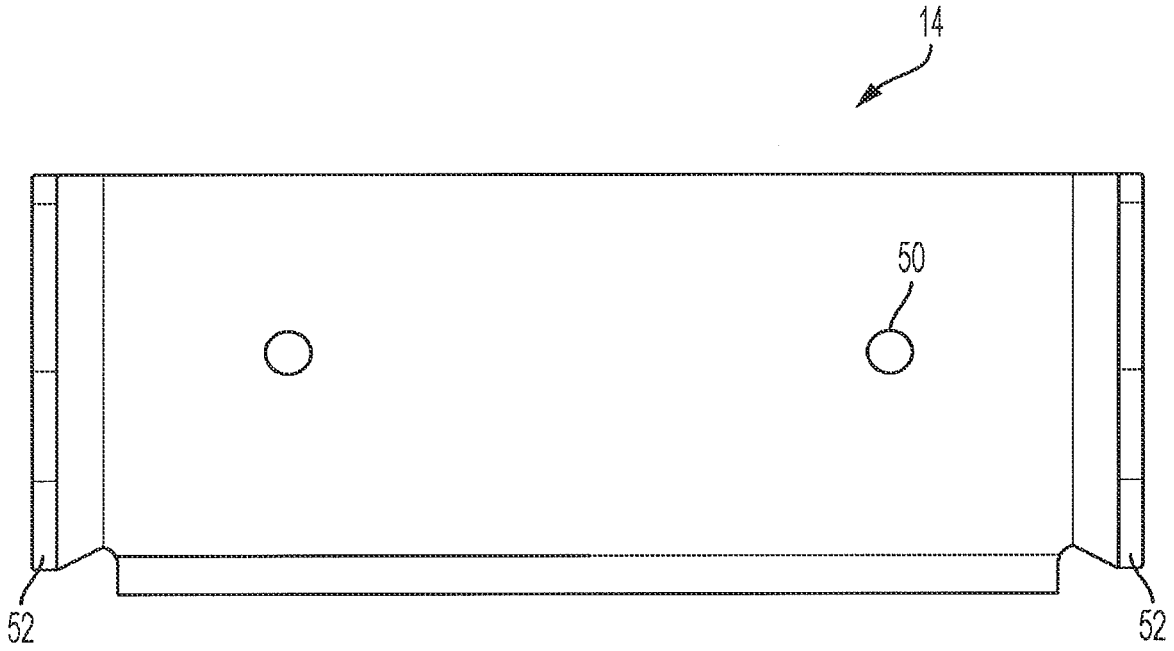
FIG. 4 is a rear view of a U-shaped mounting member of the hinge assembly of FIG. 1.
Figure 5:
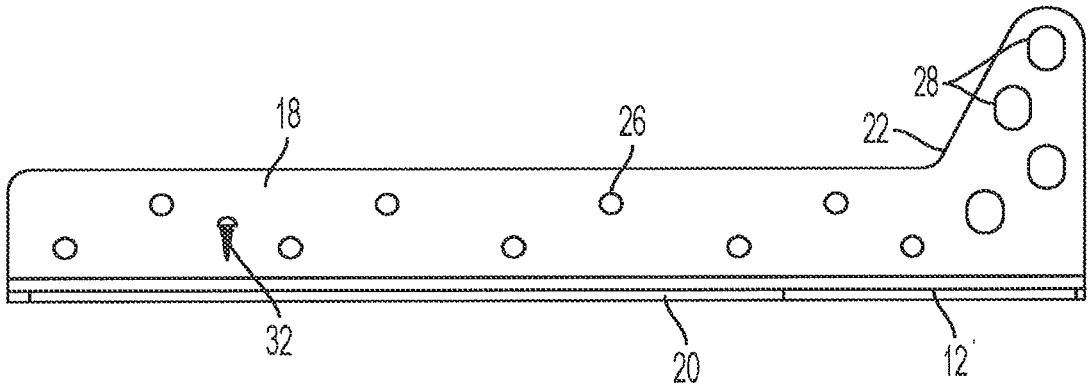
FIG. 5 is a side view of a lower mounting bracket of the hinge assembly of FIG. 1.

With reference next to the drawings, there is shown a hinge assembly 10 in a preferred form of the invention. In one form of the invention, the hinge assembly 10 is utilized with a conventional roof ventilation system 1 that includes a fan base housing or curb 2, a showbox-style lid 3 having a top lid surface 4 and peripheral downwardly extending sides or sidewalls 5 (the front and back sidewalls may be considered to be end walls 7), and a ventilation fan 6.

The hinge assembly 10 includes a pair of lower mounting brackets 12, at least two upper hinge leaves 14, and an axle rod or axle 16 pivotally coupling the upper hinge leaves 14 to the lower mounting brackets 12.

Each lower mounting bracket 12 has an elongated vertical portion or flange 18 and an elongated horizontal portion or flange 20 extending perpendicularly to the vertical flange 18. The vertical flange 18 includes an upwardly extending projection 22. Each vertical flange 18 has a series of screw mounting holes 26 and a series of vertically oval-shaped or elongated axle holes 28 extending therethrough. The terms vertical oval, vertically oval-shaped, or the like, is intended to mean that the longer or major axis of the oval is oriented generally vertically while the shorter or minor axis of the oval is oriented generally horizontally. Each horizontal flange 20 also has a series of screw mounting holes 30 therethrough. Mounting screws 32 are passed through either vertical flange screw mounting holes 26 or horizontal flange screw mounting holes 30 and into the fan base housing 2. The determination of which screw mounting holes 26 or 30 to utilize depends on which surface of the roof ventilation system 1 the hinge assembly 10 is to be mounted.

Each upper hinge leaf 14 includes a J-shaped or U-shaped mounting portion or member 36 and a hook or L-shaped clamping plate 38 adjustable coupled for varied vertical positioning to the U-shaped member 36 through a pair of threaded tension bolts 40. The U-shaped member 36 has a front wall or plate 42 integrally extending to a rear wall or plate 44 along a bight or bend 46 so as to define a lid sidewall channel 48 therebetween. The rear wall 44 has a pair of internally threaded bolt mounting holes 50 therethrough configured to receive the threaded end of the tension bolt 40. A pair of mounting side walls, flanges or ears 52 extend perpendicularly from the rear wall 44. Each mounting ear 52 has a circular axle hole 54 therethrough that is alignable with the elongated axle hole 28 of the lower mounting bracket vertical flange 18.

Each clamping plate 38 has a vertical wall, member, or plate 56 extending to an abutment flange 58 extending generally perpendicularly to the vertical wall 56. The vertical wall 56 has two elongated bolt adjustment slots 60 extending therethrough. The bolt adjustment slots 60 are generally alignable with the bolt mounting holes 50 of the upper hinge leaf rear wall 44.

Each tension bolt 40 has an externally threaded shaft 64, a bolt head 66, a tensioning nut 68 threadably mounted to the threaded shaft 64 for threaded movement there along. A washer 70 is also coupled to the threaded shaft 64 between the tensioning nut 68 and the clamping plate 38. The shafts 64 of the tension bolts 40 extend through the washers 70 and the elongated slots 60 and are threaded into the internally threaded bolt mounting holes 50.

The axle 16 extends through the elongated axle holes 28 of the lower mounting bracket vertical flange 18 and through the circular axle holes 54 of the U-shaped member mounting ears 52. A locking washer or cap 72 is coupled to the ends of the axle to prevent the accidental removal of the axle 16.

All components of the hinge assembly 10 may be made of conventionally know materials, such as aluminum, stainless steel, galvanized steel, nickel plated steel, or the like.

In use, the U-shaped member 36 is coupled to the sidewall 5 of the lid 3 of the fan base housing 2. With the tension bolts 40 only slightly threaded into bolt mounting holes 50, or removed altogether, the lid 3 bottom edge is inserted into the lid sidewall channel 48. The tension bolts 40 are then tightened so that the ends of the bolt shafts 64 bear against the sidewalls 5 of the lid 3, thus coupling the upper hinge leaves 14 to the lid 3. The hook shaped clamping plate 38 is then positioned so that the abutment flange 58 abuts the top surface 4 of the lid 3. The tensioning nuts 68 are then threaded down the bolt shaft 64 of tension bolts 40 until they bear against the outboard surface of the vertical wall 56 of the clamp plate 38. As such, the lid 3 is securely captured or encapsulated between the U-shaped member 36 and the clamping plate 38, thereby securely locking the position of the upper hinge leaves 14 upon the lid 3.

With the lid 3 in its closed position, the lower mounting brackets 12 are then pivoted about axle 16 and into a position wherein the vertical flange 18 abuts the fan base housing 2, as shown in FIG. 1. Mounting screws 32 are passed through screw mounting holes 26 and threaded into fan base housing 2 to secure the position of the lower mounting brackets 12 to the fan base housing 2.

The lid 3 and the accompanying ventilation fan 6 may now be pivoted between a closed position and an open position through operation of the hinge assembly 10. Specifically, the upper hinge leaves 14 rotate or pivot about axle 16, as the axle 16 passes through axle holes 54 within the ears 52 of the U-shaped member 36. Although the axle 16 passes through an oval shaped axle mounting hole 28 within the vertical flange 18, the axle 16 remains in a stable position. A conventional limiting chain 7 may be utilized to limit or act as a hold open retainer the pivoting of the lid 3.

As such, a hinge assembly comprises a pair of upper hinge leaves wherein each upper hinge leaf has a U-shaped member with a pair of mounting flanges having first axle holes therethrough. Each upper hinge leaf also has a clamping plate adjustably mounted to the U-shaped member. The hinge assembly also has a pair of lower mounting brackets, wherein each lower mounting bracket has at least one second axle hole therethrough. The hinge assembly also has an axle extending through the first axle holes of the pair of upper hinge leaves and through the second axle holes of the pair of lower mounting brackets.

Figure 6:
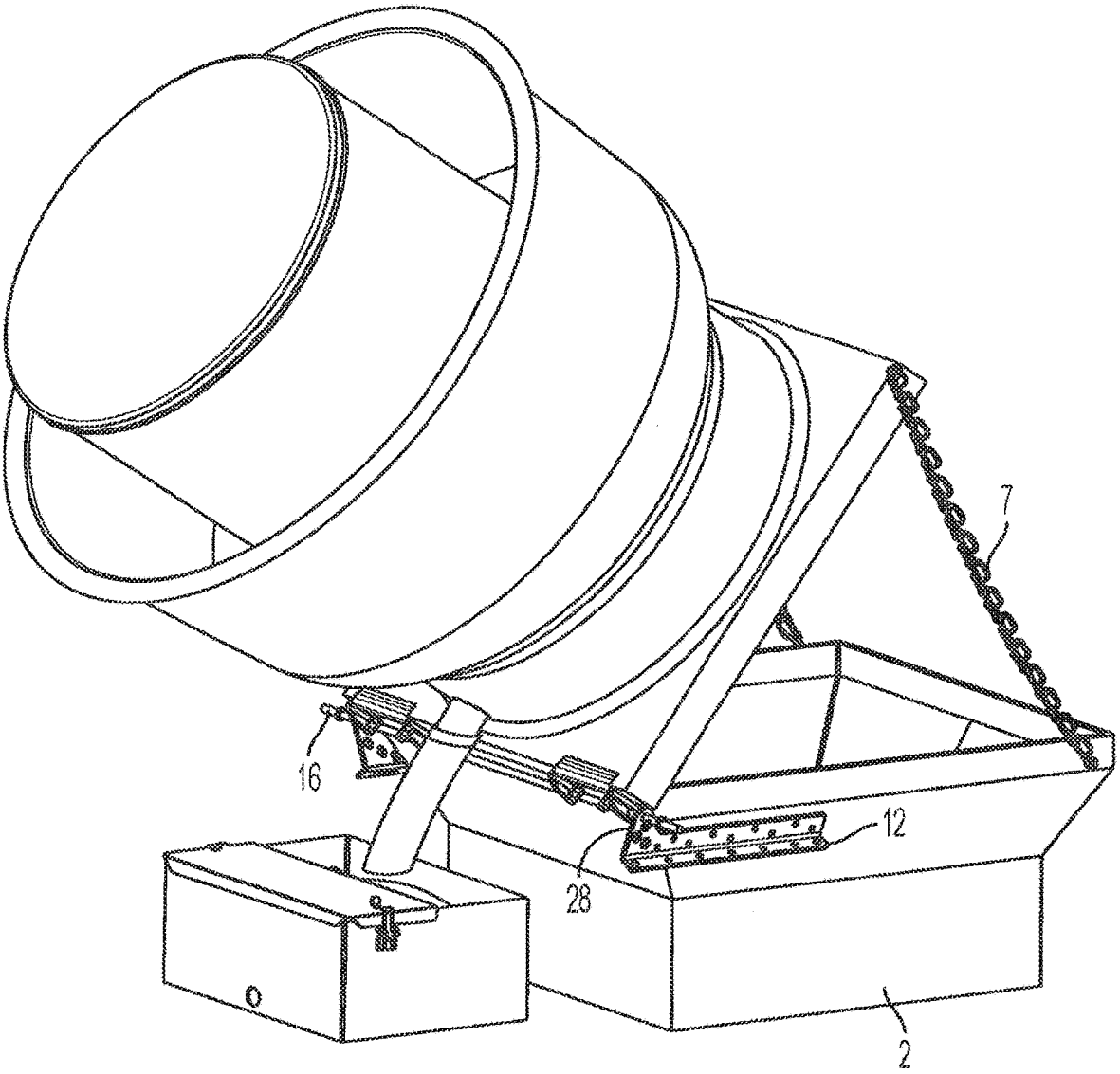
FIG. 6 is a perspective view of the hinge assembly embodying principles of the invention in another preferred form, shown mounted to the side surface of a conventional roof ventilation system having a fan base housing with angled sidewalls.

Alternatively, the lower mounting bracket 12 may be mounted to an angled fan base housing 2, as shown in FIG. 6. Here, the mounting procedure is essentially the same as that just described. However, as the lower mounting brackets 12 are set at an angle corresponding to that of the angled fan base housing 2, the oval shape of the axle holes 28 allows the passage and seating of the axle within the axle holes 28 while maintaining a snug fit thereon. Without such an oval shape, a circular shape of the axle 16 would bind on the axle hole, i.e., a circular axle hole set at an angle would not properly accommodate a circular axle therein.

Figure 7:
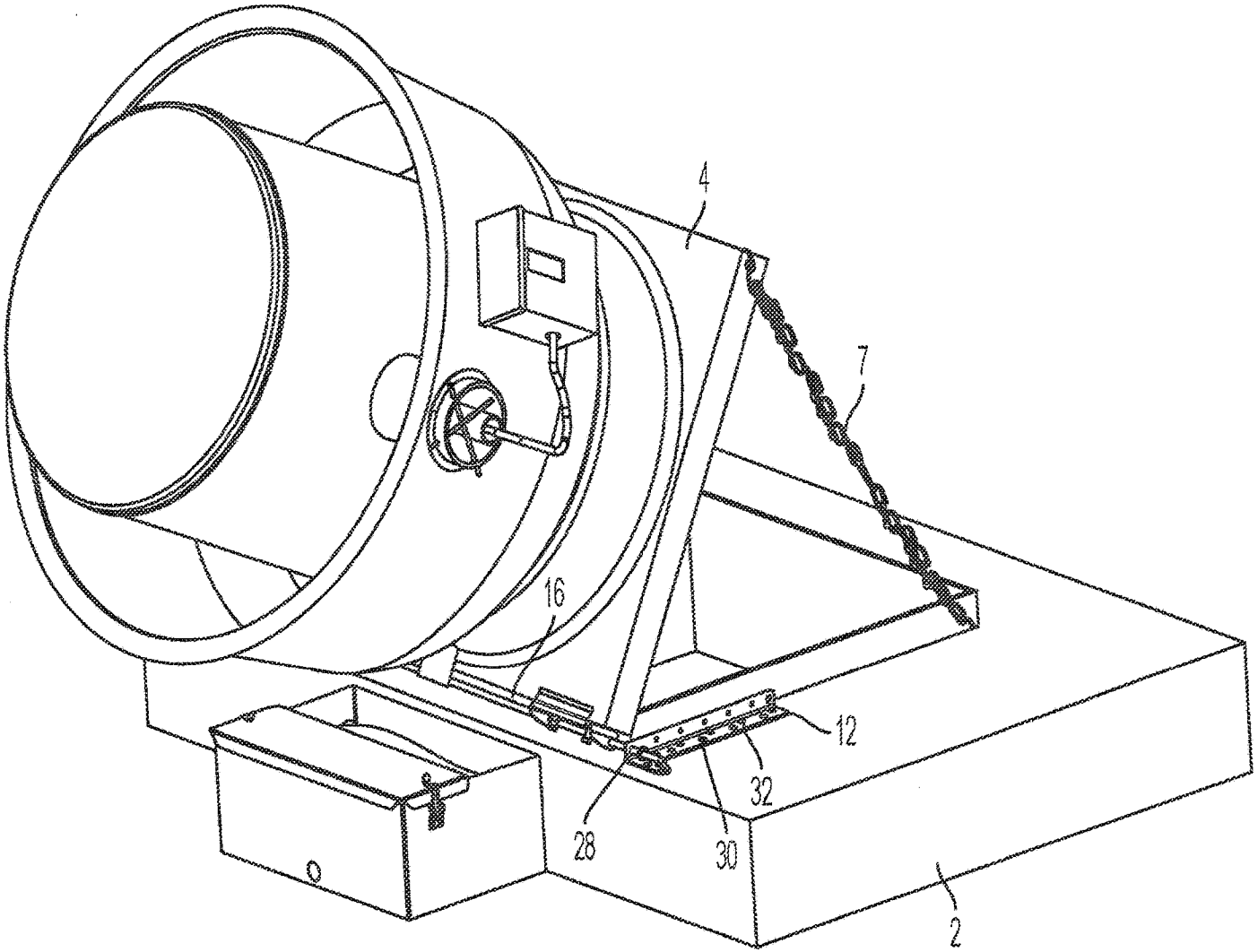
FIG. 7 is a perspective view of the hinge assembly embodying principles of the invention in another preferred form, shown mounted to a top surface of a conventional roof ventilation system having a fan base housing.

As another alternative mounting, the lower mounting brackets 12 are pivoted about axle 16 and into a position wherein the horizontal flange 20 abuts the top surface 4 of the lid 3 of the fan base housing 2, as shown in FIG. 7. Here, the mounting screws 32 are passed through screw mounting holes 30 and threaded into a top surface or deck 4 of the fan base housing 2.

Figure 8:
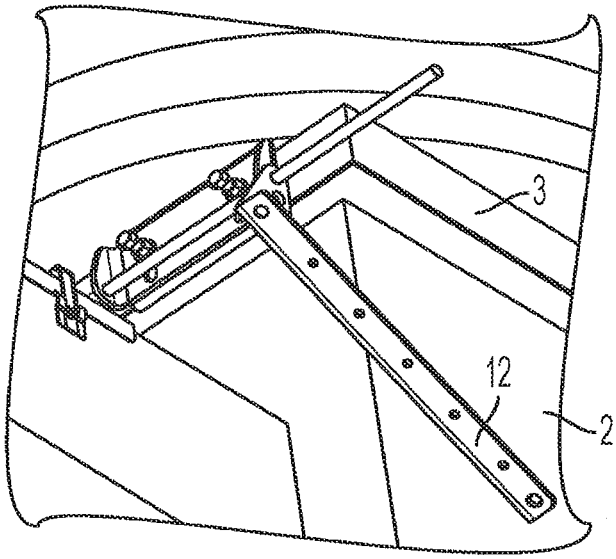
FIG. 8 is a perspective view of the hinge assembly embodying principles of the invention in another preferred form, shown mounted to the conventional roof ventilation system with an elongated bracket.

As another alternative mounting, the lower mounting brackets 12 are mounted to at an angle or incline, as shown in FIG. 8.

Figure 9:
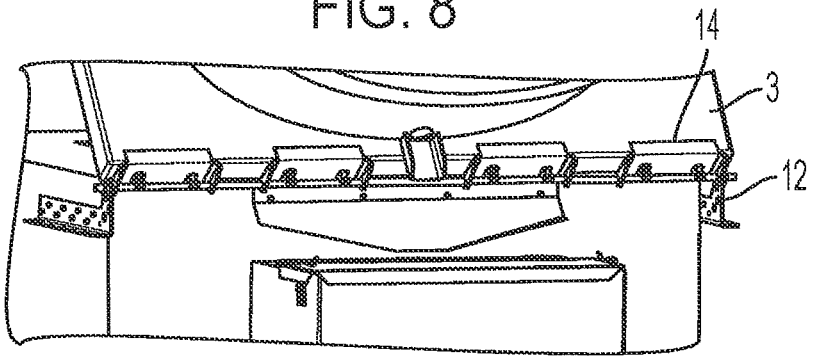
FIG. 9 is a perspective view of the hinge assembly embodying principles of the invention in another preferred form.

As another alternative mounting, there are four upper mounting leaves 14, as shown in FIG. 9.

Figure 10:
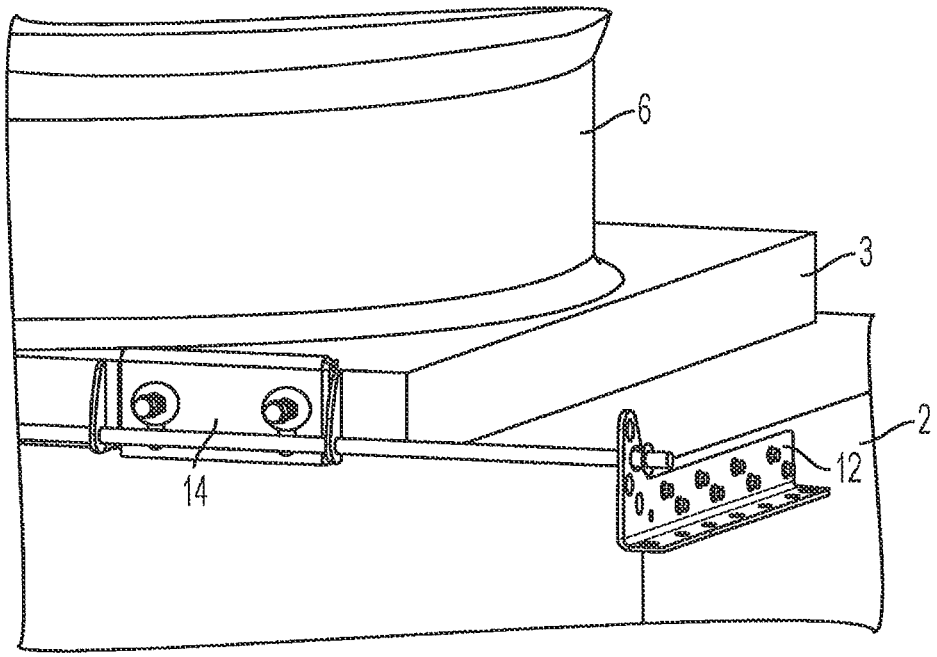
FIG. 10 is a perspective view of the hinge assembly embodying principles of the invention in another preferred form.
Figure 11:
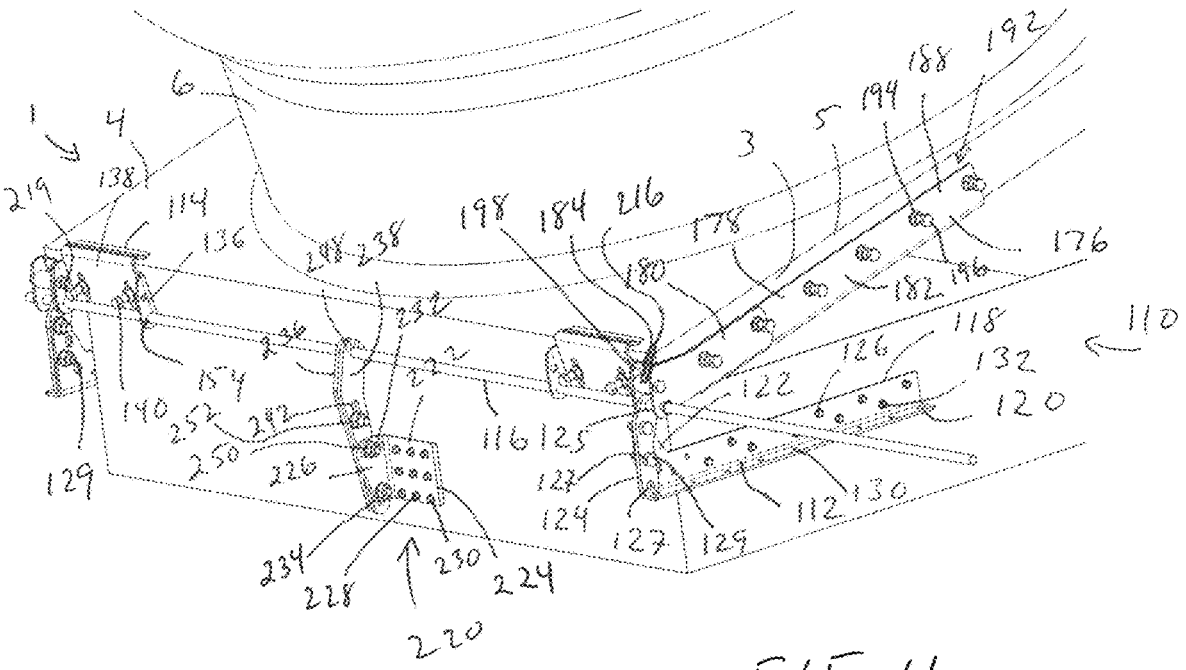
FIG. 11 is a perspective view of the hinge assembly embodying principles of the invention in another preferred form, shown mounted to the side surface of a conventional roof ventilation system having a fan base housing with vertical sidewalls.
Figure 12:
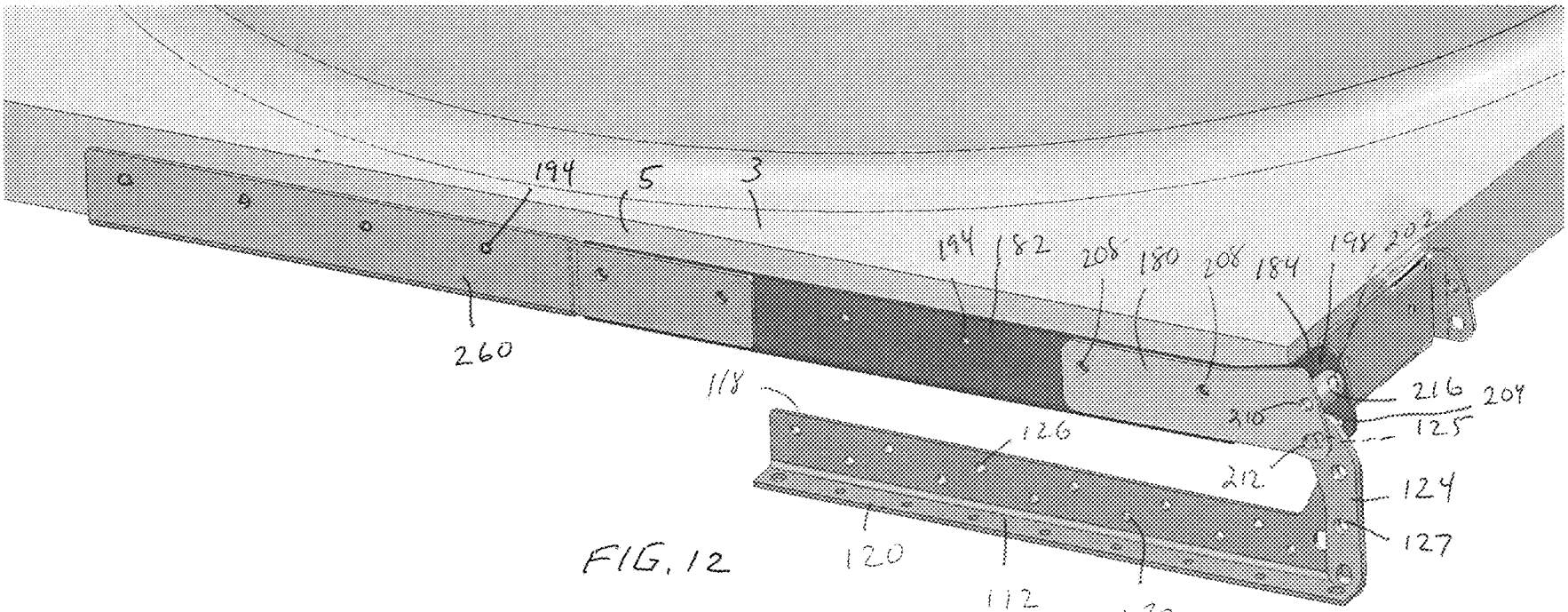
FIG. 12 is a perspective view of a portion of the hinge assembly of FIG. 11.

As another alternative mounting, the lower mounting brackets 12 are mounted to the curbs that are more narrow or wider than the fan base 2, as shown in FIG. 10.

In reference next to FIGS. 11-14, there is shown another alternative embodiment of the present invention, the hinge assembly 110 is once again shown utilized with a conventional roof ventilation system 1 that includes a fan base housing or curb 2, a showbox-style lid 3 having a top lid surface 4 and peripheral downwardly extending sides or sidewalls 5, the front and back sidewalls may be considered to be end walls 7, and a ventilation fan 6.

The hinge assembly 110 includes a pair of lower mounting brackets 112, at least two upper hinge leaves 114, and an axle rod or axle 116 pivotally coupling the upper hinge leaves 114 to the lower mounting brackets 112.

Each lower mounting bracket 112 has an elongated vertical portion or flange 118 and an elongated horizontal portion or flange 120 extending perpendicularly to the vertical flange 118. The vertical flange 118 includes an upwardly extending projection 122. Each vertical flange 118 has a series of screw mounting holes 126 and a series of vertically oval-shaped or elongated axle holes 128 extending therethrough. The terms vertical oval, vertically oval-shaped, or the like, is intended to mean that the longer or major axis of the oval is oriented generally vertically while the shorter or minor axis of the oval is oriented generally horizontally. Each horizontal flange 120 also has a series of screw mounting holes 130 therethrough. Mounting screws 132 are passed through either vertical flange screw mounting holes 126 or horizontal flange screw mounting holes 130 and into the fan base housing 2. The determination of which screw mounting holes 126 or 130 to utilize depends on which surface of the roof ventilation system 1 the hinge assembly 110 is to be mounted.

Each lower mounting bracket 112 may include an optional gooseneck adapter 124 having a top axle hole 125 and a series of bolt holes 127. The top axle hole 125 is configured to receive the axle rod 116. Mounting bolts 129 extend through mutually aligned bolt holes 127 and axle holes 28 of the vertical flange projections 122 to mount the gooseneck adapter 124 to the vertical flange projection 122.

Each upper hinge leaf 114 includes a J-shaped or U-shaped mounting portion or member 136 and a hook or L-shaped clamping plate 138 adjustable coupled for varied vertical positioning to the U-shaped member 136 through a pair of threaded tension bolts 140. As previously described, the U-shaped member 136 has a front wall or plate 42 integrally extending to a rear wall or plate 44 along a bight or bend 46 so as to define a lid sidewall channel 48 therebetween. The rear wall 44 has a pair of internally threaded bolt mounting holes 50 therethrough configured to receive the threaded end of the tension bolt 40. A pair of mounting side walls, flanges or ears 52 extend perpendicularly from the rear wall 44. Each mounting ear 52 has a circular axle hole 54 therethrough that is alignable with the elongated axle hole 28 of the lower mounting bracket vertical flange 118.

As previously described, each clamping plate 138 has a vertical wall, member, or plate 56 extending to an abutment flange 58 extending generally perpendicularly to the vertical wall 56. The vertical wall 56 has two elongated bolt adjustment slots 60 extending therethrough. The bolt adjustment slots 60 are generally alignable with the bolt mounting holes 50 of the upper hinge leaf rear wall 44.

As previously described, each tension bolt 40 has an externally threaded shaft 64, a bolt head 66, a tensioning nut 68 threadably mounted to the threaded shaft 64 for threaded movement there along. A washer 70 is also coupled to the threaded shaft 64 between the tensioning nut 68 and the clamping plate 138. The shafts 64 of the tension bolts 40 extend through the washers 70 and the elongated slots 60 and are threaded into the internally threaded bolt mounting holes 50.

The hinge assembly 110 also includes a pair of elongated side brackets 176 mounted to the sidewalls 5 of the lid 3. Each side bracket 176 includes first portion 178 and a second portion 180.

The first portion 178 has an elongated sidewall portion 182 and a L-shaped in-turned end portion 184 extending from the sidewall portion 182. The sidewall portion 182 has an inner or interior plate 186 that abuts the interior surface of the lid sidewall 5 and an exterior or outer plate 188 that abuts the exterior surface of the lid sidewall 5. The inner plate 186 and outer plate 188 are coupled together along their bottom edge by a bridge portion 190, thus, the sidewall portions 182 capture the lid sidewalls 5 within a channel 192 defined by the inner plate 186, bridge portion 190, and outer plate 188. The outer plate 188 of each sidewall portion 182 has a series of bolt mounting holes 194 in which are mounted mounting bolts 196. The bolts 196 extend through the bolt mounting holes 194 and bear against the lid sidewalls 5 to hold the side brackets 176 in place upon the lid sidewalls 5. The in-turned end portion 184 extends past the lid 3 and is spaced from the second portion 180 to create a space 198 therebetween. The in-turned end portion 184 has an upper mounting hole 202 and a lower mounting hole 204.

The second portion 180 has two bolt mounting holes 208 alignable with bolt holes 194, an upper mounting hole 210 alignable with mounting hole 202, and a lower mounting hole 212 alignable with mounting hole 204 and gooseneck top axle hole 125. A tubular arm spacer or stop 216 is positioned in the space 198 between and in alignment with first portion mounting hole 202 and second portion mounting hole 210, so that a mounting bolt 219 extends through these holes and the arm stop 216 to mount the arm stop 216 in this position. The mounting bolts 196 also pass through mounting holes 208 to secure the second portions 180 to the first portions 178, and thereby the lid sidewalls 5. The arm spacer or stop 216 is positioned so that the arm spacer 216 contacts the upper, side edge of the second portion 180 to prevent further pivotal movement of the lid 3 and maintain the maximum opened position of the opened lid 3.

The hinge assembly 110 also includes a reinforcement assembly, bracket or brace 220 mounted to the sidewall 5 of the lid 3 between the two upper hinge leaves 114. The reinforcement assembly 220 includes an L-shaped mount 222 having a sidewall mounting plate 224 and a mounting flange 226. The mounting plate 224 has a series of mounting holes 228 through which extend mounting bolts 230 to mount the mounting plate 224 to the fan base housing or curb 2. The mounting flange 226 has an elongated top mounting hole 232 and a round lower mounting hole 234.

Figures 13, 14:
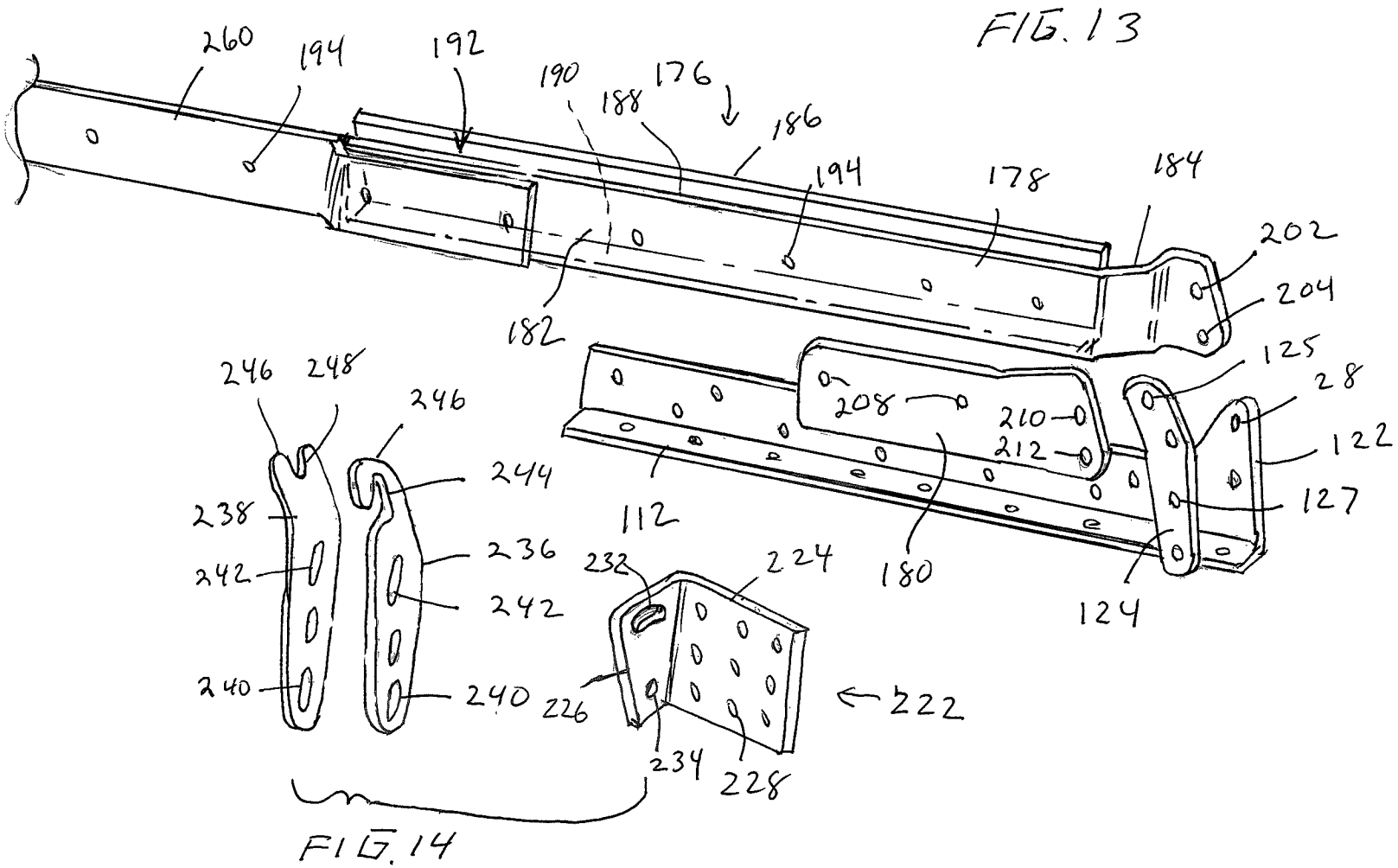
FIG. 13 is a perspective view of a portion of the hinge assembly of FIG. 11.
FIG. 14 is a perspective view of a portion of the hinge assembly of FIG. 11.

The reinforcement assembly 220 also has a first axle adapter 236 and a second axle adapter 238. As best shown in FIG. 14, the first axle adapter 236 has two elongated lower mounting holes 240, an elongated top mounting hole 242, and an L-shaped slot 244 adjacent the top end 246 of the first axle adapter 236. The second axle adapter 238 has two elongated lower mounting holes 240, an elongated top mounting hole 242, and an elongated slot 248 extending from the top end 246 of the second axle adapter 238. The elongated slot 248 is aligned with the majority portion of the L-shaped slot 244 of the first axle adapter 236. Mounting bolts 250 extend through the lower mounting holes 240 and mounting hole 234 to secure the first and second axle adapters 236 and 238 to the L-shaped mount 222. A mounting bolt 252 extends through mounting holes 242 and 232 to secure the first and second axle adapters 236 and 238 to each other. The axle 116 passes through the L-shaped slot 244 of the first axle adapter 236 and the elongated slot 248 of the second axle adapter 238 to aid in supporting the axle 116 when the lid 3 is raised.

The axle 116 extends through the top axle holes 125 of the gooseneck adapter 124, through second portion mounting hole 212, through first portion mounting hole 210, and through the circular axle holes 54 of the U-shaped member mounting ears 52. The axle 116 may also extend through the L-shaped slot 244 and elongated slot 248 of the optional reinforcement assembly 220. The configuration of the L-shaped slot 244 prevents the axle from being dislodged. A locking washer or cap 72 is coupled to the ends of the axle 116 to prevent the accidental removal of the axle 116.

All components of the hinge assembly 110 may be made of conventionally known materials, such as aluminum, stainless steel, galvanized steel, nickel plated steel, or the like.

In use, the U-shaped member 136 is coupled to the sidewall 5 of the lid 3 of the fan base housing 2. With the tension bolts 140 only slightly threaded into bolt mounting holes 50, or removed altogether, the lid 3 bottom edge is inserted into the lid sidewall channel 48. The tension bolts 140 are then tightened so that the ends of the bolt shafts 64 bear against the sidewalls 5 of the lid 3, thus coupling the upper hinge leaves 114 to the lid 3. The hook shaped clamping plate 38/138 is then positioned so that the abutment flange 58 abuts the top surface 4 of the lid 3. The tensioning nuts 68 are then threaded down the bolt shaft 64 of tension bolts 40/140 until they bear against the outboard surface of the vertical wall 56 of the clamp plate 138. As such, the lid 3 is securely captured or encapsulated between the U-shaped member 36 and the clamping plate 138, thereby securely locking the position of the upper hinge leaves 114 upon the lid 3.

With the lid 3 in its closed position, the lower mounting brackets 112 are then pivoted about axle 116 and into a position wherein the vertical flange 118 abuts the fan base housing 2. Mounting screws 32 are passed through screw mounting holes 26 and threaded into fan base housing 2 to secure the position of the lower mounting brackets 12 to the fan base housing 2.

The lid 3 and the accompanying ventilation fan 6 may now be pivoted between a closed position and an open position through operation of the hinge assembly 10. Specifically, the upper hinge leaves 14 rotate or pivot about axle 16, as the axle 16 passes through axle holes 54 within the ears 52 of the U-shaped member 36. Although the axle 16 passes through an oval shaped axle mounting hole 28 within the vertical flange 18 or top axle hole 125 of the gooseneck adapter 124, the axle 16 remains in a stable position. A conventional limiting chain 7 may be utilized to limit or act as a hold open retainer the pivoting of the lid 3.

The hinge assembly 110 may also includes an optional extension plate 260 that is mounted to the sidewall 5 of the lid 3 and the sidewall portion 182 of the side bracket 176. The extension plate 260 also includes mounting holes 194 through which mounting bolts 196 extend. The extension plate 260 provides additional structural support to the lid 3 and additional strength to the hinge assembly 110.

As such, a hinge assembly comprises a pair of upper hinge leaves wherein each upper hinge leaf has a U-shaped member with a pair of mounting flanges having first axle holes therethrough. Each upper hinge leaf also has a clamping plate adjustably mounted to the U-shaped member. The hinge assembly also has a pair of lower mounting brackets, wherein each lower mounting bracket has at least one second axle hole therethrough. The hinge assembly also has an axle extending through the first axle holes of the pair of upper hinge leaves and through the second axle holes of the pair of lower mounting brackets.

It should be understood that the axle hole 54 of the U-shaped member 36/136 is oriented or positioned above and offset from the bottommost portion of the U-shaped member 36/136 in the area of bight 46. With this orientation, the pivoting motion of the upper hinge leaves 14/114 causes the immediate rising of the bottommost portion. This offset and resulting motion allows for a minimum height requirement or clearance so that the upper hinge leaves 14/114 do not contact the underlying fan base housing 2.

It should be understood that by capturing the lid 3 between the U-shaped member 36/136 and the clamping plate 38/138, the hinge assembly 10/110 provides a greater degree of safety from accidental separating or slipping of the lid from the hinge. This mounting also eliminates the need to penetrate the lid with mounting screws, which may cause weakness in the lid or allow water intrusion.

It should also be understood that the present hinge assembly allows for additional upper hinge leaves 14/114 to be mounted to the axle 16/116 to provide greater strength. For example, with heavier ventilation fans, additional upper hinge leaves 14/114 may be coupled to the axle 16/116 to spread out the amount of weight, torquing, or load upon each upper hinge leaf 14/114, i.e., the hinge assembly is not limited to only two upper hinge leaves 14/114. The additional upper hinge leaves 14/114 may also prolong the service life of the fan base housing 2, lid 3 and ventilation fan 6 by providing additional strength, stability, and security.

Lastly, it should be understood that while the hinge assembly 10/110 has been shown coupled to the housing of a roof ventilation system, the hinge assembly 10/110 may also be utilized in another applications, environments, or the like.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A hinge assembly adapted to be pivotally mounted on a ventilation fan lid having end walls and sidewalls to a fan base housing, the hinge assembly comprising:

a pair of upper hinge leaves coupled to the end walls of the ventilation fan lid, each upper hinge leaf having a U-shaped member with a pair of mounting flanges having first axle holes therethrough, each upper hinge leaf also having a clamping plate adjustably mounted to said U-shaped member;

a pair of lower mounting brackets coupled to the fan base housing, each lower mounting bracket having at least one second axle hole therethrough, a pair of side brackets coupled to the sidewalls of the ventilation fan lid, each side bracket having at least one third axle hole therethrough, and an axle extending through said first axle holes of said pair of upper hinge leaves, through said second axle holes of said pair of lower mounting brackets, and through said third axle holes of said pair of side brackets.

2. The hinge assembly of claim 1 wherein each said side bracket includes an interior plate mounted to abut an interior surface of the sidewall of the ventilation fan lid, and an exterior plate mounted to abut an exterior surface of the sidewall of the ventilation fan lid.

3. The hinge assembly of claim 2 wherein each said interior plate is coupled to said exterior plate through a bridge, the combination of the interior plate, exterior plate and bridge creating a lid sidewall channel in which resides the sidewall of the ventilation fan lid.

4. The hinge assembly of claim 1 wherein each said side bracket also includes a first portion having a sidewall portion that abuts the sidewall of the ventilation fan lid and an end portion extending from said sidewall portion, each said side bracket also has a second portion coupled to said first portion to form a sidewall channel therebetween, and wherein said end portion includes said third axle hole and wherein said second portion includes a fourth axle hole.

5. The hinge assembly of claim 4 wherein each said side bracket also includes a stop coupled to and extending between said end portion and said second portion.

6. The hinge assembly of claim 4 wherein each said lower mounting bracket includes a lengthening adapter coupled to said end portion, and wherein said lengthening adapter includes said second axle hole of each said lower mounting bracket.

7. The hinge assembly of claim 1 wherein each said U-shaped member includes at least one bolt mounting holes, wherein each said clamping plate includes at least one bolt slot, and wherein each upper hinge leaf includes a mounting bolt extending through said at least bolt slot and threaded into said at least one bolt mounting hole.

8. The hinge assembly of claim 1 further comprising a reinforcement brace mounted to the lid, said reinforcement brace including a top axle hole through which extends said axle.

9. A hinge assembly for use with a rooftop ventilator having a base housing, a lid operatively attached to the base housing, wherein the lid has a plurality of lid sides extending downwardly from a lid top surface, and a ventilation fan positioned above the lid surface, said hinge assembly comprising:

at least one upper hinge leaf having a mounting member with a front wall integrally extending to a rear wall to form a lid channel therebetween, said mounting member having mounting flange with first axle holes therethrough, said at least one upper hinge leaf also having a clamping plate coupled to said at mounting member, said clamping plate having an abutment flange extending over said lid channel to capture the base housing lid within the lid channel between said mounting member and said abutment flange;

a pair of lower mounting brackets, each lower mounting bracket having at least one second axle hole therethrough;

a pair of side brackets coupled to the sidewalls of the ventilation fan lid, each side bracket having at least one third axle hole therethrough, and an axle rod extending through said first axle holes of said upper hinge leaf, through said second axle holes of said pair of lower mounting brackets, and through said third axle holes of said pair of side brackets.

10. The hinge assembly of claim 9 wherein each said side bracket includes an interior plate mounted to abut an interior surface of the sidewall of the ventilation fan lid, and an exterior plate mounted to abut an exterior surface of the sidewall of the ventilation fan lid.

11. The hinge assembly of claim 10 wherein each said interior plate is coupled to said exterior plate through a bridge, the combination of the interior plate, exterior plate and bridge creating a lid sidewall channel in which resides the sidewall of the ventilation fan lid.

12. The hinge assembly of claim 9 wherein each said side bracket also includes a first portion having a sidewall portion that abuts the sidewall of the ventilation fan lid and an end portion extending from said sidewall portion, each said side bracket also has a second portion coupled to said first portion to form a sidewall channel therebetween, and wherein said end portion includes said third axle hole and wherein said second portion includes a fourth axle hole.

13. The hinge assembly of claim 12 wherein each said side bracket also includes a stop coupled to and extending between said end portion and said second portion.

14. The hinge assembly of claim 9 wherein each said mounting member includes at least one bolt mounting holes, wherein each said clamping plate includes at least one bolt slot, and wherein each upper hinge leaf includes a mounting bolt extending through said at least bolt slot and threaded into said at least one bolt mounting hole.

15. The hinge assembly of claim 12 wherein each said lower mounting bracket includes a lengthening adapter coupled to said end portion, and wherein said lengthening adapter includes said second axle hole of each said lower mounting bracket.

16. The hinge assembly of claim 9 further comprising a reinforcement brace mounted to the lid, said reinforcement brace including a top axle hole through which extends said axle.

17. A hinge assembly adapted to be pivotally mounted on a ventilation fan lid having end walls and sidewalls, said hinge assembly comprising:

a pair of upper hinge leaves, each upper hinge leaf having a U-shaped member with a pair of mounting flanges having at least one first axle hole therethrough, each upper hinge leaf also having a glamping plate mounted to said U-shaped member;

a pair of lower mounting brackets, each lower mounting bracket having at least one second axle hole therethrough, a pair of side brackets coupled to the sidewalls of the ventilation fan lid, each side bracket having at least one third axle hole therethrough, and an axle extending through said at least one first axle holes, said at least one second axle holes, and said at least one third axles holes, wherein each said side bracket also includes a first portion having sidewall portion that abuts the sidewall of the ventilation fan lid and an end portion extending from said sidewall portion, each said side bracket also has a second portion coupled to said first portion to form a sidewall channel therebetween, and why rein said end portion includes said third axle hole and herein said second portion includes a fourth axle hole.

18. The hinge assembly of claim 17 wherein each said side bracket includes an interior plate mounted to abut an interior surface of the sidewall of the ventilation fan lid, and an exterior plate mounted to abut an exterior surface of the sidewall of the ventilation fan lid.

19. The hinge assembly of claim 18 wherein each said interior plate is coupled to said exterior plate through a bridge, the combination of the interior plate, exterior plate and bridge creating a lid sidewall channel in which resides the sidewall of the ventilation fan lid.

20. The hinge assembly of claim 17 wherein each said side bracket also includes a stop coupled to and extending between said end portion and said second portion.

21. The hinge assembly of claim 17 wherein each said U-shaped member includes at least one bolt mounting holes, wherein each said clamping plate includes at least one bolt slot, and wherein each upper hinge leaf includes a mounting bolt extending through said at least one bolt slot and threaded into said at least one bolt mounting hole.

22. The hinge assembly of claim 17 wherein each said lower mounting bracket includes a lengthening adapter coupled to said end portion, and wherein said lengthening adapter includes said second axle hole of each said lower mounting bracket.

23. The hinge assembly of claim 17 further comprising a reinforcement brace mounted to the lid, said reinforcement brace including a top axle hole through which extends said axle.

* * * * *